US008039059B2

(12) United States Patent
Ishihara

(10) Patent No.: US 8,039,059 B2
(45) Date of Patent: Oct. 18, 2011

(54) METHOD FOR MANUFACTURING PRODUCT

(75) Inventor: Haruhiko Ishihara, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 609 days.

(21) Appl. No.: 12/127,543

(22) Filed: May 27, 2008

(65) Prior Publication Data

US 2008/0299321 A1 Dec. 4, 2008

(30) Foreign Application Priority Data

May 30, 2007 (JP) ..... P2007-143508

(51) Int. Cl.
*B05D 1/34* (2006.01)

(52) U.S. Cl. ..... 427/426

(58) Field of Classification Search ..... 427/426
See application file for complete search history.

(56) References Cited

U.S. PATENT DOCUMENTS

| | | | | |
|---|---|---|---|---|
| 6,077,338 | A | 6/2000 | Wallström | |
| 2005/0181287 | A1 * | 8/2005 | Yamada | 430/7 |

FOREIGN PATENT DOCUMENTS

| | | | |
|---|---|---|---|
| JP | 2002-019148 | | 1/2002 |
| JP | 2006-062225 | | 3/2006 |
| JP | 2006-122814 | | 5/2006 |
| JP | 2006122814 | * | 5/2006 |

OTHER PUBLICATIONS

Japanese Office Action mailed on Jun. 28, 2011, with English translation, issued for JP Application No. 2007-143508, filed on May 30, 2007.

* cited by examiner

*Primary Examiner* — Timothy Meeks
*Assistant Examiner* — Nathan T Leong
(74) *Attorney, Agent, or Firm* — Oblon, Spivak, McClelland, Maier & Neustadt, L.L.P.

(57) ABSTRACT

A method for manufacturing a product includes: filling, with a dispersion medium, an internal flow path and a liquid chamber of a droplet-jetting head for jetting droplets of liquid filled in the liquid chamber through the internal flow path, the internal flow path and the liquid chamber communicating with each other; filling the internal flow path and the liquid chamber of the droplet-jetting head with a dispersion liquid containing particles in place of the dispersion medium filled in the internal flow path and the liquid chamber; and applying the dispersion liquid droplets onto an object to be coated from the droplet-jetting head filled with the dispersion liquid.

3 Claims, 4 Drawing Sheets

METHOD FOR MANUFACTURING PRODUCT

CROSS REFERENCE OF THE RELATED APPLICATION

This application is based on and claims the benefit of priority from Japanese Patent Application No. 2007-143508, filed on May 30, 2007; the entire contents of which are incorporated herein by reference.

BACKGROUND OF THE INVENTION

1. Field of the Invention

The present invention relates to a method for manufacturing a product by jetting droplets to an object to be coated.

2. Description of the Related Art

A droplet-jetting applicator is used not only in printing image information, but also in manufacturing steps for various flat panel displays: specifically, a liquid-crystal display, an organic EL (Electro Luminescence) display, an electron-emitter display, a plasma display, an electrophoretic display, and so forth.

The droplet-jetting applicator includes a droplet-jetting head (for example, an inkjet head) which jets droplets of a dispersion liquid such as ink, through multiple nozzles, to an object such as a substrate to be coated with the droplets. In this type of droplet-jetting applicator, the droplets from the droplet-jetting head are landed on the object to be coated therewith, and a predetermined coating pattern is formed to manufacture various products. Note that a dispersion liquid such as ink is filled through internal flow paths into multiple liquid chambers of the droplet-jetting head.

In general, a droplet-jetting-head filling device is used at an initial filling stage of filling the droplet-jetting head with a dispersion liquid (i.e., filling of empty internal flow paths and liquid chambers in the droplet-jetting head). At the initial filling stage, by utilizing a water-head difference, a pump or the like, this droplet-jetting-head filling device sends a dispersion liquid to the internal flow paths and liquid chambers thereof so slowly that the internal flow paths and liquid chambers can be filled without air bubbles remaining in the internal flow paths and liquid chambers. The flow rate at this stage is controlled so that, for example, a 10-cc dispersion liquid may be gradually filled into the internal flow paths and liquid chambers of the droplet-jetting head for approximately 30 minutes to 60 minutes.

The dispersion liquid used here includes multiple, for example, spacer particles and the like as a coating material. This dispersion liquid is formed by dispersing multiple particles in a dispersion medium. It should be noted that the spacer particles and the like are easily deposited in the medium, causing failure in jetting droplets by the droplet-jetting head. Against this problem, a printing method has been proposed to prevent the spacer particles from being deposited in the droplet-jetting head after the initial filling of a spacer dispersion liquid including the multiple spacer particles (see, for example, JP-A No. 2006-122814 (KOKAI)). In this printing method, a spacer dispersion liquid is either discharged from the droplet-jetting head, or supplied to and discharged from the droplet-jetting head, the droplet-jetting head is initially filled with the spacer dispersion liquid. Here, this event is performed depending on whether the already-filled droplet-jetting head is in a printing state or a waiting state.

Meanwhile, as described above, the dispersion liquid needs to be filled slowly so that the air bubbles can be prevented from remaining at the initial filling stage. Since the particles in the dispersion liquid are likely to be deposited during this filling stage, the multiple deposited particles may clog a nozzle of the droplet-jetting head, causing a failure in jetting droplets by the droplet-jetting head such as not jetting droplets.

SUMMARY OF THE INVENTION

An object of the present invention is to provide a product-manufacturing method capable of preventing air bubbles from remaining, and also preventing a failure in jetting droplets caused by deposited particles in a dispersion liquid.

An aspect of an embodiment of the present invention provides a method for manufacturing a product, and the method includes: filling, with a dispersion medium, an internal flow path and a liquid chamber of a droplet-jetting head for jetting droplets of liquid filled in the liquid chamber through the internal flow path, the internal flow path and the liquid chamber communicating with each other; filling the internal flow path and the liquid chamber of the droplet-jetting head with a dispersion liquid containing particles in place of the dispersion medium filled in the internal flow path and the liquid chamber; and applying the dispersion liquid droplets onto an object to be coated from the droplet-jetting head filled with the dispersion liquid.

DESCRIPTION OF THE PREFERRED EMBODIMENTS

First Embodiment

Description will be given of a first embodiment of the present invention with reference to FIGS. 1 to 4.

Figure 1:
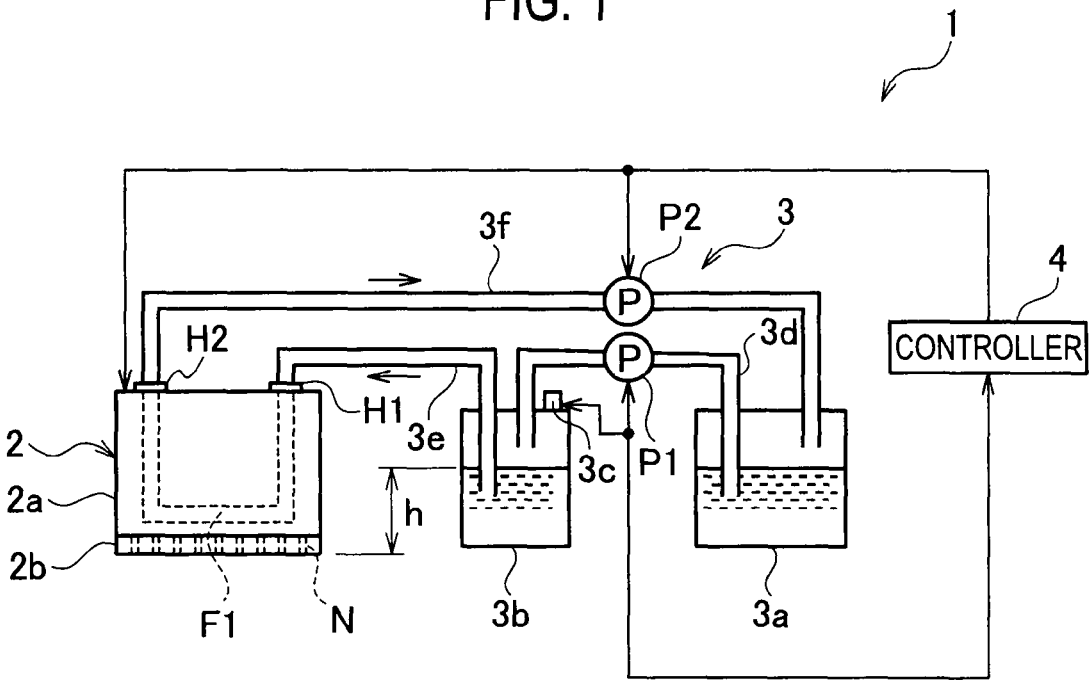
FIG. 1 is a diagrammatic illustration showing a schematic configuration of a droplet-jetting-head filling device according to a first embodiment of the present invention.

As shown in FIG. 1, a droplet-jetting-head filling device 1 according to the first embodiment of the present invention includes: a liquid supplier 3 which supplies a liquid dispersion medium in the form of liquid to a droplet-jetting head 2 for jetting droplets; and a controller 4 which controls the liquid supplier 3.

The droplet-jetting head 2 includes: a box-shaped head body 2*a*; and a nozzle plate 2*b* provided to the head body 2*a*. As an example of the droplet-jetting head 2, used is a piezoelectric droplet-jetting head with piezoelectric elements.

Figure 2:
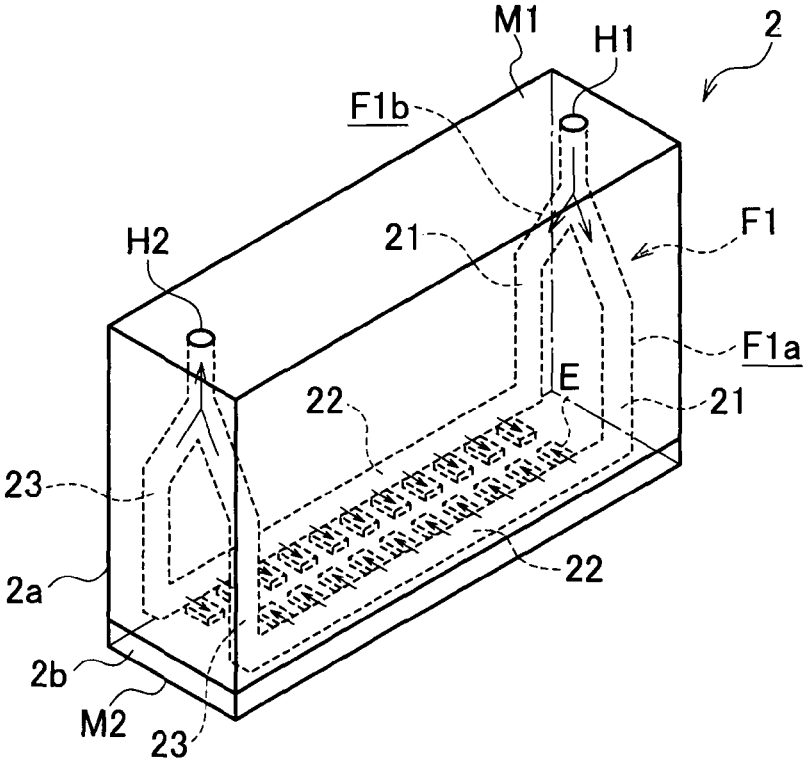
FIG. 2 is a perspective view showing a schematic configuration of a droplet-jetting head installed in the droplet-jetting-head filling device shown in FIG. 1.

As shown in FIG. 2, an inlet H1 and an outlet H2 are provided on the top surface of the head body 2*a*. A liquid supplied from the liquid supplier 3 flows through the inlet H1, and fills the droplet-jetting head 2. A liquid is discharged from the droplet-jetting head 2 through the outlet H2. These inlet H1 and outlet H2 are formed on the same plane of the head body 2*a*, the plane being opposite to an opposite surface M1 where the nozzle plate 2*b* is provided.

An internal flow path F1 and multiple liquid chambers E are provided in the head body 2*a*. The internal flow path F1 extends from the inlet H1 to the outlet H2. Each of the liquid chambers E communicates with the internal flow path F1, and accommodates a liquid flowed from the internal flow path F1.

The liquid chambers E are positioned on the nozzle plate 2*b* side of the head body 2*a*, and parallel to the nozzle plate 2*b*. The liquid chambers E are arranged in two rows in predetermined pitches. A liquid from the internal flow path F1 flows and fills the liquid chambers E.

The internal flow path F1 is configured to diverge at certain point and again converge. The internal flow path F1 consists of a first internal flow path F1*a* and a second internal flow path F1*b*. The first internal flow path F1*a* consists of: a first flow path 21 extending toward the nozzle plate 2*b*; a second flow path 22 bent at and continued from the end of the first flow path 21 while communicating with the liquid chambers E; and a third flow path 23 bent at and continued from the end of the second flow path 22 to communicate with the outlet H2. Note that the second internal flow path F1*b* has the same configuration as that of the first internal flow path Fla.

The first flow path 21 and the third flow path 23 extend substantially vertical to the nozzle plate 2*b*, while the second flow path 22 extends substantially in parallel to the nozzle plate 2*b*. Accordingly, the first internal flow path F1*a* and the second internal flow path F1*b* have bending portions where the first flow path 21 and the second flow path 22 communicate with each other, and where the second flow path 22 and the third flow path 23 communicate with each other.

As referred back to FIG. 1, the nozzle plate 2*b* is provided with multiple nozzles (through holes) N which communicate with the respective liquid chambers E. The nozzles N are provided in the nozzle plate 2*b*, and arranged in two rows in the predetermined pitches. For example, the number of nozzle N is approximately several tens to several hundreds. The diameter of the nozzle N is approximately several tens of μm. The pitch (interval) between the two nozzles N is approximately several tens of μm to several hundreds of μm. The outside surface of the nozzle plate 2*b* is a nozzle surface M2.

The droplet-jetting head 2 configured in this way changes the volumes of the liquid chambers E with application of driving voltages to multiple piezoelectric elements (unillustrated) formed for the corresponding liquid chambers E. Then, the head 2 jets, as droplets, the liquids accommodated in the liquid chambers E, through the corresponding nozzles N toward an object to be coated, thereby forming a predetermined dot pattern on the surface of the coated object.

Herein, a cap (unillustrated) for covering all of the nozzles N may be provided to the nozzle plate 2*b* when a liquid fills the droplet-jetting head 2. The cap is a member to prevent the liquid from spilling through the droplet-jetting head 2 during the filling. The cap is detachably formed on the droplet-jetting head 2. Incidentally, when the size of the nozzle N is too small for the liquid to spill therethrough, it is not necessary to provide the cap. The size of the nozzle N not to let the liquid spill during the filling varies depending on various factors such as the kind and viscosity of the liquid.

The liquid supplier 3 includes: a main tank 3*a* which accommodates a liquid dispersion medium in the form of liquid; a buffer tank (intermediate tank) 3*b* which adjusts a water-head difference h; a sensor 3*c* which detects the amount of liquid in a buffer tank 3*b*; a liquid-transfer pump P1 which supplies the droplet-jetting head 2 with the dispersion medium; and a liquid-transfer pump P2 which returns the dispersion medium to the main tank 3*a* from the droplet-jetting head 2.

The main tank 3*a* is an accommodation unit to accommodate the dispersion medium which fills the droplet-jetting head 2. Meanwhile, the buffer tank 3*b* adjusts a liquid surface (meniscus) of the dispersion medium at the nozzle tip, while utilizing the water-head difference h between a liquid surface of the dispersion medium stored in the buffer tank 3*b* and the nozzle surface M2 of the droplet-jetting head 2. This prevents a leakage of the dispersion medium and a jetting failure.

Herein, the dispersion medium is a liquid for dispersing multiple particles in a dispersion liquid. The dispersion medium is used for forming the dispersion liquid including the particles such as spacer particles serving as a coating material. With this dispersion medium, the droplet-jetting-head filling device 1 fills the multiple liquid chambers E accommodating liquids and the internal flow path F1 in the droplet-jetting head 2. Note that the size of the spacer particle is, for example, on the order of several μm such as 5 μm. As an example of the coating material, a particle of fluorescent material may be used sometimes.

The sensor 3*c* is, for example, a liquid-surface sensor which detects a height of a liquid surface of the dispersion medium in the buffer tank 3*b*. The sensor 3*c* is electrically connected to the controller 4. Such a sensor 3*c* detects that the dispersion medium in the buffer tank 3*b* is reduced to a predetermined value or less and then transmits a signal indicating the detection to the controller 4. Note that, as an example of the sensor 3*c*, used is a reflection-type sensor, ultrasonic-type sensor, or the like.

The main tank 3*a* and the buffer tank 3*b* are connected to each other with a liquid-supplying flow path 3*d* through which the liquid flows. The liquid-supplying flow path 3*d* communicates the main tank 3*a* with the buffer tank 3*b*, and supplies the buffer tank 3*b* with the dispersion medium in the main tank 3*a*. For example, a tube or pipe is used as the liquid-supplying flow path 3*d*.

The buffer tank 3*b* and the droplet-jetting head 2 are connected to each other with a liquid-supplying flow path 3*e* through which the liquid flows. The liquid-supplying flow path 3*e* communicates the buffer tank 3*b* with the inlet H1 of the droplet-jetting head 2, and supplies the droplet-jetting head 2 with the dispersion medium in the buffer tank 3*b*. For example, a tube or pipe is used as the liquid-supplying flow path 3*e*.

The droplet-jetting head 2 and the main tank 3*a* are connected to each other with a liquid-returning flow path 3*f* through which the liquid flows out from the outlet H2 of the droplet-jetting head 2. The liquid-returning flow path 3*f* communicates the main tank 3*a* with the outlet H2 of the droplet-jetting head 2. The liquid-returning flow path 3*f* returns, to the droplet-jetting head 2, the dispersion medium passed through the internal flow path F1 of the droplet-jetting head 2. For example, a tube or pipe is used as the liquid-returning flow path 3*f*.

The liquid-transfer pump P1 is provided in the liquid-supplying flow path 3*d*, while the liquid-transfer pump P2 is provided in the liquid-returning flow path 3*f*. These liquid-transfer pumps P1, P2 are electrically connected to the controller 4, and serve as driving sources for transferring a dispersion medium.

The controller 4 includes: a microcomputer to control each unit; a storage to save a control program and various data; and the like and controls units such as the droplet-jetting head 2 and the liquid supplier 3. Moreover, the controller 4 controls, for example, the liquid-transfer pumps P1, P2 so that the flow rate (flow velocity) of the liquid filled in the droplet-jetting head 2 can be constant. The flow rate at this point is controlled so that, for example, a 10-cc dispersion medium may gradually fill the internal flow path F1 and the liquid chambers E of the droplet-jetting head 2 for approximately 30 minutes to 60 minutes. Thereby, air bubbles are prevented from remaining in the internal flow path F1 and the liquid chambers E. Incidentally, the flow rate is set depending on a flow-path structure of the droplet-jetting head 2, the type of dispersion medium, and the like.

Figure 3:
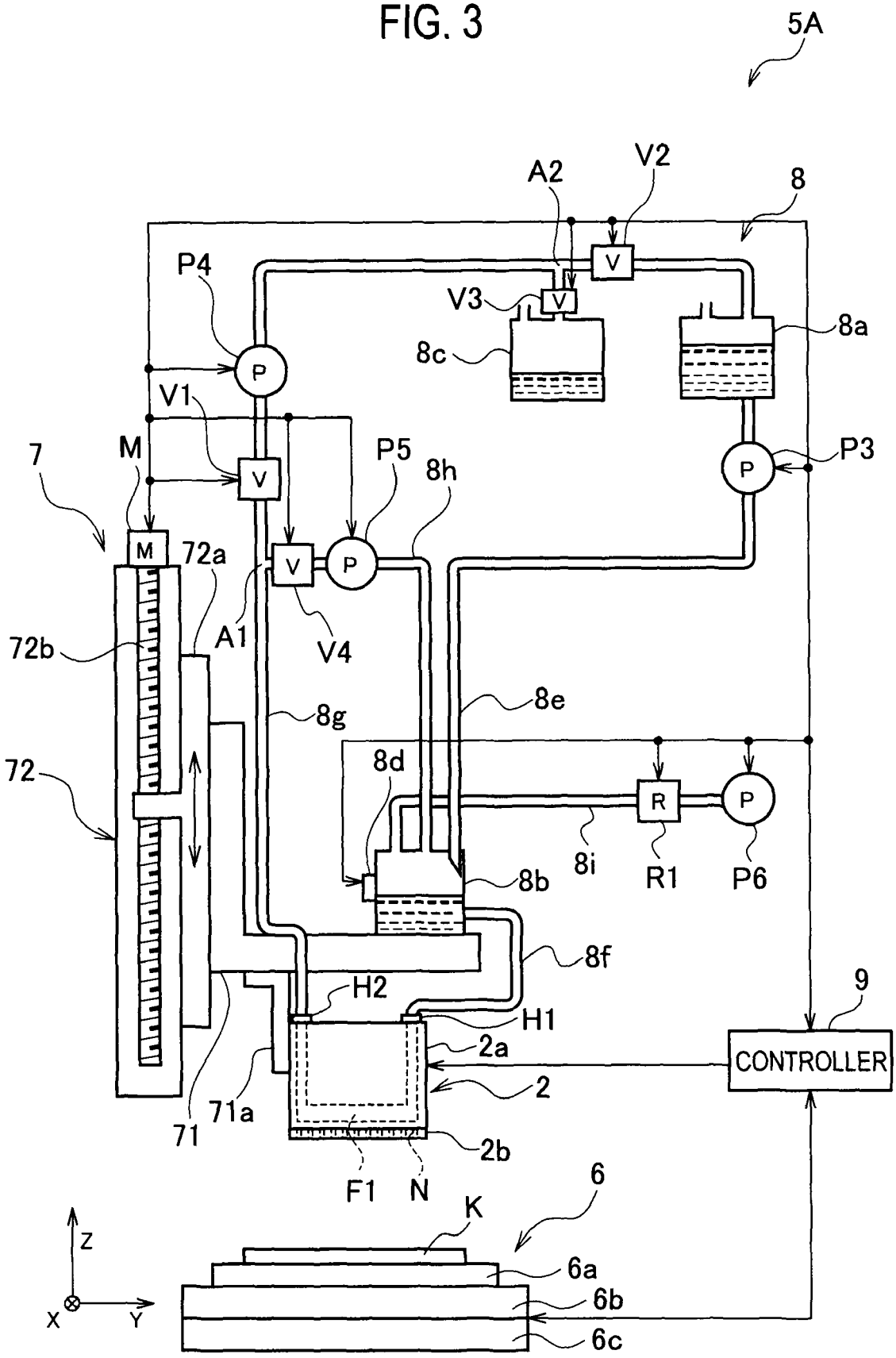
FIG. 3 is a perspective view showing a schematic configuration of a droplet-jetting applicator according to the first embodiment of the present invention.

Next, as shown in FIG. 3, a droplet-jetting applicator 5A according to the first embodiment of the present invention includes: a substrate-moving mechanism 6 which moves a substrate K, being an object to be coated, in an X-axis direction and an Y-axis direction (two axis directions orthogonal to each other on a level plane); a head-moving mechanism 7 which detachably supports and moves the droplet-jetting head 2 in a z-axis direction (an axis direction orthogonal to the level plane); a liquid supplier 8 which supplies a dispersion liquid in the form of liquid to the droplet-jetting head 2 supported by the head-moving mechanism 7; and a controller 9 which controls these substrate-moving mechanism 6, head-moving mechanism 7 and liquid supplier 8.

The substrate-moving mechanism 6 includes: a holding table 6*a* which holds the substrate K; an X-axis-moving table 6*b* which moves the holding table 6*a* in the X-axis direction; and a Y-axis-moving table 6*c* which moves the X-axis-moving table 6*b* in the Y-axis direction. The substrate-moving mechanism 6 is electrically connected to the controller 9.

The holding table 6*a* is fixed to the upper surface of the X-axis-moving table 6*b*. The holding table 6*a* is provided with an absorbing mechanism (unillustrated) to absorb the substrate K and thereby fix and hold the substrate K on the upper surface of the X-axis-moving table 6*b*. For example, an air-absorbing mechanism is used as the absorbing mechanism.

The X-axis-moving table 6*b* is provided on the upper surface of the Y-axis-moving table 6*c*, and movable in the X-axis direction thereon. The X-axis-moving table 6*b* moves in the X-axis direction with a feeding mechanism (unillustrated) using a feed screw and a driving motor.

The Y-axis-moving table 6*c* is provided on the upper surface of a frame or the like, and movable in the Y-axis direction thereon. The Y-axis-moving table 6*c* moves in the Y-axis direction with a feeding mechanism (unillustrated) using a feed screw and a driving motor.

The head-moving mechanism 7 includes: a supporting member 71 which supports the droplet-jetting head 2; and a Z-axis-moving mechanism 72 which moves the supporting member 71 in a direction perpendicular to a coated surface of the substrate K on the holding table 6*a*, that is, in the Z-axis direction. This makes the droplet-jetting head 2 movable in the Z-axis direction.

The supporting member 71 is a member to support the droplet-jetting head 2 with an attachment 71*a*. The droplet-jetting head 2 is attached to the surface of the supporting member 71 with the attachment 71*a*, the surface being on the substrate-moving mechanism 6 side. Note that, the droplet-jetting head 2 attached to the head-moving mechanism 7 is already filled with a dispersion medium.

The Z-axis moving mechanism 72 includes: a moving stage 72*a* attached with the supporting member 71 and movable in the Z-axis direction; a screw shaft 72*b* which is a feed screw to move the moving stage 72*a* in the Z-axis direction; and a motor M which is a driving source of the screw shaft 72*b*. The Z-axis moving mechanism 72 moves the moving stage 72*a* in the Z-axis direction by the screw shaft 72*b* rotated by the driving of the motor M, and thereby moves the droplet-jetting head 2 supported by the supporting member 71 in the Z-axis direction.

The liquid supplier 8 includes: a main tank 8*a* which accommodates a dispersion liquid in the form of liquid; a buffer tank (intermediate tank) 8*b* which makes the liquid pressure of the dispersion liquid in the droplet-jetting head 2 be a negative pressure; a waste-liquid tank 8*c* which accommodates a dispersion medium discharged from the droplet-jetting head 2 having been filled with the dispersion medium; a sensor 8*d* which detects the amount of liquid in the buffer tank 8*b*; a liquid-transfer pump P3 which supplies the buffer tank 8*b* with the dispersion liquid; a liquid-transfer pump P4 which returns the liquid discharged from the droplet-jetting head 2 (dispersion liquid or dispersion medium) to the main tank 8*a* or the waste-liquid tank 8*c*; a liquid-transfer pump P5 which returns the liquid discharged from the droplet-jetting head 2 to the buffer tank 8*b*; and a vacuum pump P6 which generates a negative pressure in the buffer tank 8*b*.

The main tank 8*a* is an accommodation unit to accommodate the dispersion liquid which fills the droplet-jetting head 2. Meanwhile, the buffer tank 8*b* makes the liquid pressure of the dispersion liquid in the droplet-jetting head 2 be a negative pressure. The buffer tank 8*b* is provided on a surface of the supporting member 71, the surface being opposite to the surface where the droplet-jetting head 2 is attached. Note that, the dispersion liquid from a flow path is stored in the buffer tank 8*b* in a manner that the dispersion liquid is flowed along an internal wall of the buffer tank 8*b*. At this point, even if there exist air bubbles in the flow path, the air bubbles are removed. The waste-liquid tank 8*c* is an accommodation unit to accommodate the dispersion medium discharged from the droplet-jetting head 2 having been filled with the dispersion medium.

The dispersion liquid used herein includes multiple particles such as spacer particles serving as a coating material. This dispersion liquid is formed by dispersing multiple particles in a dispersion medium. More specifically, the dispersion liquid is configured of: particles to be remained on the substrate K as a residue; and the dispersion medium in which the particles are dispersed. Note that, as an example of the dispersion medium, used is a dispersion medium of the same kind as that fills the droplet-jetting head 2 by the above-described droplet-jetting-head filling device 1. In this case, the manufacturing cost can be reduced because it is not necessary to prepare a dispersion medium of a different kind from the above. Furthermore, it is possible to prevent the different kind of dispersion medium from being mixed with the above dispersion medium.

The sensor 8*d* is, for example, a liquid-surface sensor which detects a height of a liquid surface of the dispersion liquid in the buffer tank 8*b*. The sensor 8*d* is electrically connected to the controller 9. Such a sensor 8*d* detects that the dispersion liquid in the buffer tank 8*b* is reduced to a predetermined value or less and then transmits a signal indicating the detection to the controller 9. Note that, as an example of the sensor 8*d*, used is a reflection-type sensor, ultrasonic-type sensor, or the like.

The main tank 8*a* and the buffer tank 8*b* are connected to each other with a liquid-supplying flow path 8*e* through which the liquid flows. The liquid-supplying flow path 8*e* communicates the main tank 8*a* with the buffer tank 8*b*, and supplies the buffer tank 8*b* with the dispersion liquid in the main tank 8*a*. For example, as the liquid-supplying flow path 8*e*, used is a tube or pipe.

The buffer tank 8*b* and the droplet-jetting head 2 are connected to each other with a liquid-supplying flow path 8*f* through which the liquid flows. The liquid-supplying flow path 8*f* communicates the buffer tank 8*b* with the inlet H1 of the droplet-jetting head 2, and supplies the droplet-jetting head 2 with the dispersion liquid in the buffer tank 8*b*. For example, as the liquid-supplying flow path 8*f*, used is a tube or pipe.

The droplet-jetting head 2 and the main tank 8*a* as well as the waste-liquid tank 8*c* are connected to each other with a liquid-returning flow path 8*g* through which the liquid flows. The liquid-returning flow path 8*g* communicates the main tank 8*a* and the waste-liquid tank 8*c* with the outlet H2 of the droplet-jetting head 2. The liquid-returning flow path 8*g* returns, to the droplet-jetting head 2, the dispersion liquid passed through the internal flow path F1 of the droplet-jetting head 2. Furthermore, the dispersion medium discharged from the droplet-jetting head 2 flows through the liquid-returning flow path 8*g* to the waste-liquid tank 8*c*. For example, used is a tube or pipe as the liquid-returning flow path 8*g*.

The droplet-jetting head 2 and the buffer tank 8*b* are connected to each other with a liquid-returning flow path 8*h* through which the liquid flows. The liquid-returning flow path 8*h* extends from a certain point of the liquid-returning flow path 8*g* to the buffer tank 8*b*, and returns the dispersion liquid passed through the internal flow path F1 of the droplet-jetting head 2 to the buffer tank 8*b*. The flow path 8*h* communicates the buffer tank 8*b* with the inlet H1 of the droplet-jetting head 2, and supplies the droplet-jetting head 2 with the dispersion liquid in the buffer tank 8*b*. For example, used is a tube or pipe as the liquid-returning flow path 8*g*.

The liquid-transfer pump P3 is provided in the liquid-supplying flow path 8*e*, while the liquid-transfer pump P4 is provided in the liquid-returning flow path 8*g*. In addition, the liquid-transfer pump P5 is provided in the liquid-returning flow path 8*h*. These liquid-transfer pumps P3, P4 and P5 are electrically connected to the controller 9, and serve as driving sources for transferring the liquid such as the dispersion medium and the dispersion liquid.

The vacuum pump P6 is connected to the buffer tank 8*b* with an air-discharging pipe 8*i* and is a pressure-reducing unit to reduce the pressure in the buffer tank 8*b*. Meanwhile, a regulator R1 is provided in the air-discharging pipe 8*i* to control the pressure. The vacuum pump P6 and the regulator R1 are electrically connected to the controller 9. The negative pressure generated by the vacuum pump P6 adjusts a liquid surface (meniscus) at each nozzle N of the droplet-jetting head 2. This prevents a leakage of the ink and a jetting failure.

In the liquid-returning flow path 8*g*, a valve V1 is positioned between a divergent point A1 and the liquid-transfer pump P4; a valve V2 is positioned between a divergent point A2 and the main tank 8*a*; and additionally, a valve V3 is positioned between the divergent point A2 and the waste-liquid tank 8*c*. Moreover, in the liquid-returning flow path 8*h*, a valve V4 is positioned between the divergent point A1 and the liquid-transfer pump P5. These valves V1, V2, V3, and V4 are electrically connected to the controller 9.

The controller 9 includes: a microcomputer to control each unit; a storage to save various programs and various data; and the like. The controller 9 controls units such as the substrate-moving mechanism 6, the head-moving mechanism 7 and the liquid supplier 8. The storage of the controller 9 stores, for example, coating information on coating of the substrate K with droplets. The coating information includes a coating pattern (for example, a dot pattern), a conveying speed for the substrate K, a jetting timing, and so on. The coating information is associated with a coating operation on the substrate K.

Such a controller 9 controls the substrate-moving mechanism 6 and the head-moving mechanism 7, so that the positions of the droplet-jetting head 2 and of the substrate K on the holding table 6*a* are changed relatively to each other. Moreover, the controller 9 controls, for example, the liquid-transfer pumps P3, P4 so that the flow rate (flow velocity) of the liquid filled in the droplet-jetting head 2 can be constant. Thereby, generation of air bubbles due to the flow of the liquid is suppressed.

Next, description will be given of a method of manufacturing a product by use of the above-described droplet-jetting-head filling device 1 and droplet-jetting applicator 5A, in other words, description will be given of filling and coating operations. Note that each of the controller 4 of the droplet-jetting-head filling device 1 and the controller 9 of the droplet-jetting applicator 5A performs various processings on the basis of corresponding various programs.

Figure 4:
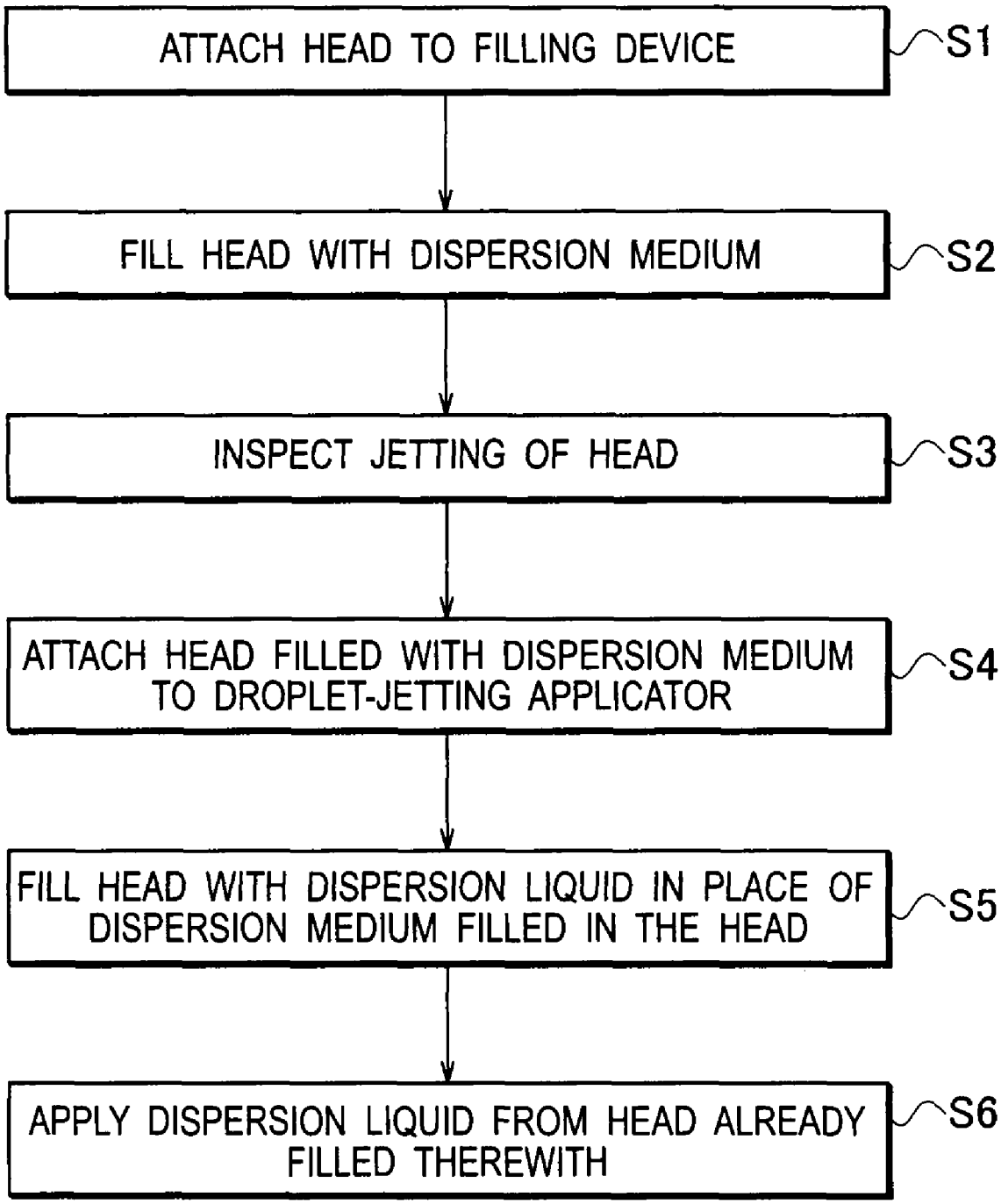
FIG. 4 is a flowchart showing a flow in a method for manufacturing a product.

As shown in FIG. 4, steps of manufacturing a product includes; a first step of attaching the droplet-jetting head 2 to the droplet-jetting-head filling device 1 (Step S1); a second step of filling the droplet-jetting head 2 with a dispersion medium (Step S2); a third step of inspecting jetting of the droplet-jetting head 2 already filled with the dispersion medium (Step S3); a fourth step of attaching the droplet-jetting head 2 already filled with the dispersion medium to the droplet-jetting applicator 5A (Step S4); a fifth step of filling the droplet-jetting head 2 already filled with the dispersion medium with a dispersion liquid in place of the dispersion medium already filled in the droplet-jetting head 2 (Step S5); and a sixth step of applying the dispersion liquid from the droplet-jetting head 2 already filled therewith (Step S6).

In Step 1, the liquid-supplying flow path 3*e* of the liquid supplier 3 equipped in the droplet-jetting-head filling device 1 is connected to the inlet H1 of the droplet-jetting head 2. The liquid-returning flow path 3*f* of the liquid supplier 3 is connected to the outlet H2 of the droplet-jetting head 2. Thus, the droplet-jetting head 2 is attached to the droplet-jetting-head filling device 1 (see FIG. 1).

In Step 2, by the droplet-jetting-head filling device 1, a dispersion medium is filled into the internal flow path F1 and the liquid chambers E of the droplet-jetting head 2 (first filling, that is, the initial filling). The controller 4 of the droplet-jetting-head filling device 1 controls the liquid-transfer pumps P1, P2 of the liquid supplier 3, so that the dispersion medium is filled into the internal flow path F1 and the liquid chambers E of the droplet-jetting head 2 from the buffer tank 3*b* through the liquid-supplying flow path 3*e*.

At this point, the controller 4 controls, for example, the liquid-transfer pumps P1, P2 so that the flow rate of the dispersion medium to be filled into the droplet-jetting head 2 can be constant. For instance, 10 cc of the dispersion medium gradually fills the internal flow path F1 and the liquid chambers E of the droplet-jetting head 2 for approximately 30 minutes to 60 minutes. Thereby, air bubbles are prevented from remaining in the internal flow path F1, the liquid chambers E, and the like.

Incidentally, during the aforementioned initial filling, the controller 4 detects, by the sensor 3*c*, the reduction in the amount of the liquid in the buffer tank 3*b*, i.e. the reduction in the height of the liquid surface. When the liquid amount is reduced to a predetermined amount or less, a dispersion medium is supplied from the main tank 3*a* to the buffer tank 3*b* through the liquid-supplying flow path 3*d* by the liquid-transfer pump P1. Thus, the liquid amount in the buffer tank 3*b* is maintained to be constant. Note that a dispersion medium discharged from the droplet-jetting head 2 is returned to the main tank 3*a* through the liquid-returning flow path 3*f*.

In Step 3, the droplet-jetting-head filling device 1 causes the droplet-jetting head 2 to jet the dispersion medium for inspection. The controller 4 of the droplet-jetting-head filling device 1 applies a driving voltage to the droplet-jetting head 2 to change the volume of each liquid chamber E. Accordingly, the droplet-jetting head 2 jets droplets of the dispersion media accommodated in the liquid chambers E from the corresponding nozzles N to a substrate for the inspection, and thereby the multiple droplets are landed on the substrate surface. Thereafter, the droplets on the substrate are inspected to determine the positions where the droplets are landed (landing pitch), the amount of the landed droplets and the like. The droplet-jetting head 2 which has passed the inspection is used in the subsequent step.

In Step 4, the droplet-jetting head 2 is attached to the head-moving mechanism 7 of the droplet-jetting applicator 5A. The liquid-supplying flow path 8*f* of the liquid supplier 8 equipped in the droplet-jetting applicator 5A is connected to the inlet H1 of the droplet-jetting head 2. Then, the liquid-returning flow path 8*g* of the liquid supplier 8 is connected to the outlet H2 of the droplet-jetting head 2 (see FIG. 3).

In Step 5, by the droplet-jetting applicator 5A, a dispersion liquid is filled into the internal flow path F1 and the liquid chambers E of the droplet-jetting head 2 already filled the dispersion medium (second filling). Specifically, the dispersion medium is discharged from the droplet-jetting head 2 already filled therewith, and the dispersion liquid is filled into the internal flow path F1 and the liquid chambers E of the droplet-jetting head 2 (pressure transferring). The controller 9 of the droplet-jetting applicator 5A controls the liquid-transfer pumps P3, P4 and the valves V1, V2, V3, and V4 of the liquid supplier 8. Thereby, the dispersion liquid in the buffer tank 8*b* is filled into the internal flow path F1 and the liquid chambers E of the droplet-jetting head 2 through the liquid-supplying flow path 8*f*, while the dispersion medium is discharged from the droplet-jetting head 2 already filled therewith to the waste-liquid tank 8*c* through the liquid-returning flow path 8*g*.

At this point, the controller 4 causes the valves V1, V3 to open, and the valves V2, V4 to close, and thereby the dispersion medium is discharged into the waste-liquid tank 8*c*. After a predetermined amount of the dispersion medium is discharged into the waste-liquid tank 8*c* (after a predetermined time elapses), the controller 4 causes the valves V1, V2 to open, and the valves V3, V4 to close. Moreover, the controller 4 controls, for example, the liquid-transfer pumps P3, P4 so that the flow rate (flow velocity) of the dispersion liquid filled into the droplet-jetting head 2 can be constant. At this time, since the droplet-jetting head 2 is filled with the dispersion medium as a result of the initial filling, the flow rate of the dispersion liquid to be filled into the head 2 can be set faster than that in Step 2.

Incidentally, during the filling of the dispersion liquid, the controller 9 detects, by the sensor 3*c*, the reduction in the amount of the liquid in the buffer tank 8*b*, i.e. the reduction in the height of the liquid surface. When the liquid amount is reduced to a predetermined amount or less, a dispersion liquid is supplied from the main tank 8*a* to the buffer tank 8*b* through the liquid-supplying flow path 8*e* by the liquid-transfer pump P3. Thus, the liquid amount in the buffer tank 8*b* is maintained to be constant. Note that the dispersion medium discharged from the droplet-jetting head 2 is returned to the main tank 8*a* through the liquid-returning flow path 8*g*.

In Step 6, the droplet-jetting-head filling device 1 causes the droplet-jetting head 2 to jet the dispersion liquid for application (application operation). The controller 9 of the droplet-jetting applicator 5A applies a driving voltage to the droplet-jetting head 2 to change the volume of each liquid chamber E, while controlling the substrate-moving mechanism 6, so that the substrate K is moved in, for example, the X-axis direction. Accordingly, the droplet-jetting head 2 jets droplets of the dispersion liquids accommodated in the liquid chambers E from the corresponding nozzles N to the substrate K to be coated, and thereby the multiple droplets are sequentially applied on the surface of the substrate K. Thereby, the surface of the substrate K is coated uniformly with the multiple particles (for example, spacer particles). In this manner, a product such as a display panel is manufactured.

At this point, the controller 9 controls the liquid-transfer pump P5 and the valves V1, V2, V3, and V4 of the liquid supplier 8. Thereby, the dispersion liquid in the droplet-jetting head 2 filled therewith is returned to the buffer tank 8*b* through the liquid-returning flow path 8*h*. Note that, the controller 9 causes the valve V4 to open, and the valves V1, V2, V3 to close in the jetting operation; the controller 9 causes the valves V1, V2, V4 to open, and the valve V3 to close in a waiting state for mounting the substrate K, replacing a stage therefor, or the like.

In this way, at the initial filling stage, the dispersion medium is slowly filled (for example, at a flow rate of filling 10 cc of the dispersion medium for approximately 30 minutes to 60 minutes), and then the dispersion liquid containing the particles, which is the coating material, is filled in the droplet-jetting head 2. In this manner, the slow filling of the dispersion medium suppresses air bubbles from remaining at the initial filling stage. In addition, since only the dispersion medium is filled at the initial filling stage, the deposition of the particles is also prevented. Thereby, it is possible to prevent air bubbles from remaining, and also to prevent a jetting failure of the droplet-jetting head 2 due to the deposition of the particles in the dispersion liquid.

Moreover, the dispersion liquid circulates through the flow paths, and also the ink of the dispersion liquid constantly circulates in the droplet-jetting head 2. Thus, the deposition of the particles in the dispersion liquid is suppressed. As a result, it is possible to prevent a jetting failure of the droplet-jetting head 2 due to the deposition of the particles. Additionally, the ink from a flow path is stored in the buffer tank 8*b* in a manner that the ink is flowed along an internal wall of the buffer tank 8*b*. At this point, even if there exist air bubbles in the liquid-supplying flow path 8*e*, air bubbles are removed. As a result, it is possible to prevent a jetting failure of the droplet-jetting head 2 due to the air bubbles.

As has been described, according to the first embodiment of the present invention, the internal flow path F1 and the liquid chambers E of the droplet-jetting head 2 is filled with a dispersion medium, and then filled with a dispersion liquid in place of the dispersion medium filled in the internal flow path F1 and the liquid chambers E of the droplet-jetting head 2. The droplet-jetting head 2 applies droplets of the dispersion liquid filled therein to the substrate K that is an object to be coated. In this manner, the dispersion medium is filled slowly at the initial filling stage. Thereafter, the dispersion medium containing particles, which is the coating material, is filled. Since the dispersion medium is filled slowly at the initial filling stage, air bubbles are suppressed from remaining in the internal flow path F1 and the liquid chambers E, and additionally the particles is suppressed from depositing at the initial filling stage. Thereby, it is possible to prevent the air bubbles from remaining, and also to prevent a jetting failure of the droplet-jetting head 2 due to the deposition of the particles in the dispersion liquid.

Second Embodiment

Description will be given of a second embodiment of the present invention with reference to FIG. 5. In the second embodiment of the present invention, the description will be given of components different from those in the first embodiment. Note that, in this second embodiment, the components described in the first embodiment are denoted by the same reference symbols, and the descriptions will be omitted.

Figure 5:
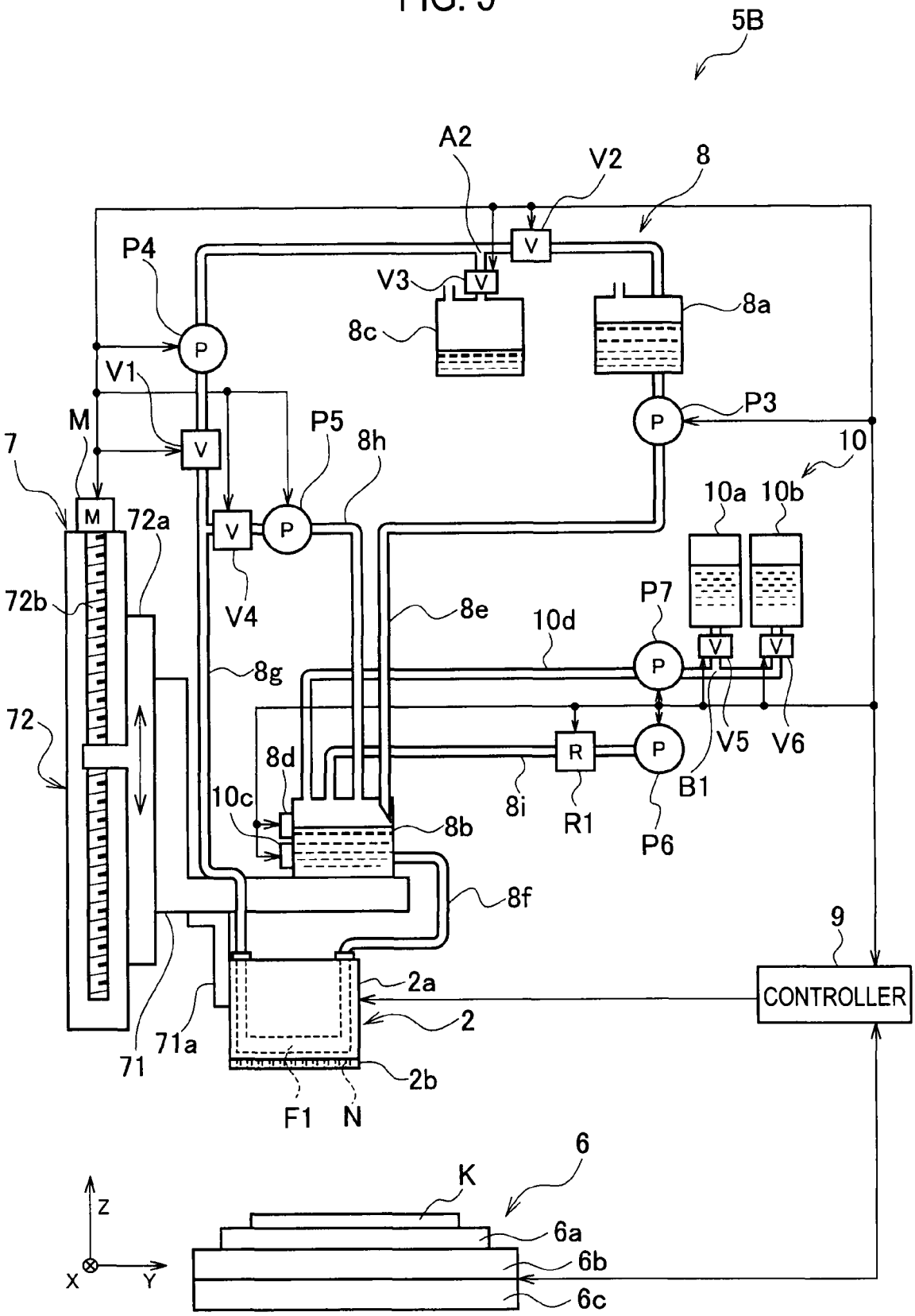
FIG. 5 is a diagrammatic illustration showing a schematic configuration of a droplet-jetting applicator according to a second embodiment of the present invention.

As shown in FIG. 5, a droplet-jetting applicator 5B according to the second embodiment of the present invention includes the substrate-moving mechanism 6, the head-moving mechanism 7, the liquid supplier 8 and the controller 9, and also includes a dispersion liquid supplier 10 which selectively supplies the liquid supplier 8 with several types of dispersion liquids (a number of dispersion liquids having different particle concentrations).

The dispersion liquid supplier 10 includes: a dispersion-liquid tank 10*a* which accommodates a first dispersion liquid; a dispersion-liquid tank 10*b* which accommodates second dispersion liquid; a concentration sensor 10*c* which detects the particle concentration of a liquid in the buffer tank 8*b* of the liquid supplier 8; and a liquid-transfer pump P7 which supplies the buffer tank 8*b* of the liquid supplier 8 with the dispersion liquids from the dispersion-liquid tanks 10*a*, 10*b*.

The dispersion-liquid tanks 10*a*, 10*b* are accommodation units to accommodate the dispersion liquids to be supplied to the buffer tank 8*b*. The dispersion liquids in the dispersion-liquid tanks 10*a*, 10*b* are continuously stirred to prevent particle deposition. Here, the first dispersion liquid and the second dispersion liquid have different particle concentrations from each other. Incidentally, the particle concentration of the first dispersion liquid is higher than that of the second dispersion liquid.

The concentration sensor 10*c* is a detector to detect the particle concentration of the liquid in the buffer tank 8*b*. The concentration sensor 10*c* is electrically connected to the controller 9. Such a concentration sensor 10*c* detects the particle concentration of the liquid in the buffer tank 8*b*, and transmits a signal indicating the detection to the controller 9. Note that, as the concentration sensor 10*c*, used is for example, an optical sensor to detect a transmitted light, a scattered light, and the like.

The dispersion-liquid tanks 10*a*, 10*b* are connected to the buffer tank 8*b* with a dispersion-liquid-supplying flow path 10*d* through which the dispersion liquids flow. The dispersion-liquid-supplying flow path 10*d* communicates the dispersion-liquid tanks 10*a*, 10*b* with the buffer tank 8*b*, and supplies the buffer tank 8*b* with the dispersion liquids from the dispersion-liquid tanks 10*a*, 10*b*. For example, a tube or pipe is used as the dispersion-liquid-supplying flow path 10*d*.

The liquid-transfer pump P7 is provided in the dispersion-liquid-supplying flow path 10*d*. The liquid-transfer pump P7 is electrically connected to the controller 9, and serves as a driving source for transferring the dispersion liquids. Moreover, in the dispersion-liquid-supplying flow path 10*d*, a valve V5 is positioned between the dispersion-liquid tank 10*a* and a divergent point B1, and a valve V6 is positioned between the dispersion-liquid tank 10*b* and the divergent point B1. These valves V5, V6 are also electrically connected to the controller 9.

In Step 5 with the droplet-jetting applicator 5B (corresponding to Step 5 in the above-described embodiment), the dispersion liquid supplier 10 adjusts the particle concentration of the dispersion liquid in the buffer tank 8*b*, i.e. the dispersion liquid in the droplet-jetting head 2 so that the particle concentration can be within a predetermined range. The controller 9 of the droplet-jetting applicator 5B detects the particle concentration of the dispersion liquid in the buffer tank 8*b* by the concentration sensor 10*c*. When the particle concentration is outside the predetermined range, the valve V5 or V6 is opened depending on the particle concentration, and thereby the dispersion liquids in the dispersion-liquid tanks 10*a*, 10*b* are supplied to the buffer tank 8*b* through the dispersion-liquid-supplying flow path 10*d* by the liquid-transfer pump P7.

When the particle concentration is lower than the predetermined range, the first dispersion liquid having a high particle concentration is supplied to the buffer tank 8*b*. Meanwhile, when the particle concentration is higher than the predetermined range, the second dispersion liquid having a lower particle concentration is supplied to the buffer tank 8*b*. It should be noted that, after a dispersion liquid is supplied, i.e. after a predetermined time elapses, the opened valve V5 or V6 is closed to circulate the dispersion liquid for a certain period. Then, the concentration sensor 10*c* again detects the particle concentration, and thus the aforementioned dispersion-liquid-supplying operation is repeated. In this manner, the particle concentration of the dispersion liquid filled in the buffer tank 8*b* is adjusted to be within the predetermined range.

As has been described, according to the second embodiment of the present invention, the same effects as those of the first embodiment can be obtained. Furthermore, according to the second embodiment, the particle concentration of the dispersion liquid is detected. Depending on the detected particle concentration, the dispersion liquid in the buffer tank 8*b* is added with a dispersion liquid having a different particle concentration from that in the buffer tank 8*b*. Thus, the particle concentration of the filled dispersion liquid is adjusted to be within the predetermined range. Thereby, the surface of the substrate K is coated uniformly with the particles of the dispersion liquid. In this manner, a failure in manufacturing a product is suppressed, and a highly reliable product is obtained.

Other Embodiments

It should be noted that the present invention is not limited to the above-described embodiments, and various modifications can be made without departing from the gist of the invention.

For example, in the above embodiments, the substrate K is moved relative to the droplet-jetting head 2 during the application operation. However, the mode of the application is not limited to this. The droplet-jetting head 2 may be moved relative to the substrate K. It is only necessary that the droplet-jetting head 2 and the substrate K be moved relative to each other.

Furthermore, in the above embodiments, only the single droplet-jetting head 2 is provided. However, the number of the droplet-jetting head 2 is not limited. The multiple droplet-jetting heads 2 may be provided.

Additionally, in the above embodiments, the droplet-jetting-head filling device 1 and the droplet-jetting applicator 5A or 5B are separately provided. However, the configuration is not limited to this. For example, the droplet-jetting-head filling device 1 may be integrally incorporated into the droplet-jetting applicator 5A or 5B.

Moreover, in the above-described second embodiment, the concentration sensor 10*c* provided to the buffer tank 8*b* detects the particle concentration of the dispersion liquid in the buffer tank 8*b*. However, the mode of the detection is not limited to this. For example, it is possible to provide the concentration sensor 10*c* in a flow path such as the liquid-returning flow path 8*g* so as to detect the particle concentration of the dispersion liquid passing through the flow path.

Still furthermore, in the above-described second embodiment, the two dispersion-liquid tanks 10*a*, 10*b* are provided;

however, the number of the dispersion-liquid tanks is not limited to this. For example, the number of the dispersion-liquid tank may be one. Alternatively, three or more of the dispersion-liquid tanks may be provided, i.e. the number is not limited. In a case where the multiple dispersion-liquid tanks are provided, it is possible to selectively mix dispersion liquids having different particle concentrations in the respective multiple dispersion-liquid tanks, thereby to supply the mixed dispersion liquids.

Lastly, various numerical values are given in the above embodiments; however, these values are merely examples, and not limiting the scope of the present invention.

What is claimed is:

1. A method for manufacturing a product comprising:

filling, with a dispersion medium, an internal flow path and a liquid chamber of a droplet-jetting head for jetting droplets of liquid filled in the liquid chamber through the internal flow path, the internal flow path and the liquid chamber communicating with each other;

filling the internal flow path and the liquid chamber of the droplet-jetting head with a dispersion liquid containing particles to replace the dispersion medium already filled in the internal flow path and the liquid chamber by the dispersion liquid, the particles not being contained in the dispersion medium; and applying the dispersion liquid droplets onto an object to be coated from the droplet-jetting head filled with the dispersion liquid.

2. The method for manufacturing a product according to claim 1, wherein a particle concentration of the dispersion liquid is detected, and the dispersion liquid is added, depending on the detected particle concentration, with another dispersion liquid, these dispersion liquids having different particle concentrations from each other.

3. The method for manufacturing a product according to claim 1, wherein a flow velocity of the dispersion liquid to be filled in the internal flow path and the liquid chamber is set faster than a flow velocity of the dispersion medium.

* * * * *